US009607761B2

(12) United States Patent
Saito

(10) Patent No.: US 9,607,761 B2
(45) Date of Patent: Mar. 28, 2017

(54) WINDING DEVICE AND METHOD FOR BINDING WIRE MATERIAL TO TERMINAL

(71) Applicant: NITTOKU ENGINEERING CO., LTD., Saitama (JP)

(72) Inventor: Tatsuya Saito, Fukushima (JP)

(73) Assignee: NITTOKU ENGINEERING CO., LTD., Saitama (JP)

( * ) Notice: Subject to any disclaimer, the term of this patent is extended or adjusted under 35 U.S.C. 154(b) by 171 days.

(21) Appl. No.: 14/403,469

(22) PCT Filed: Jul. 16, 2013

(86) PCT No.: PCT/JP2013/069279
§ 371 (c)(1),
(2) Date: Nov. 24, 2014

(87) PCT Pub. No.: WO2014/024646
PCT Pub. Date: Feb. 13, 2014

(65) Prior Publication Data

US 2015/0115092 A1 Apr. 30, 2015

(30) Foreign Application Priority Data

Aug. 8, 2012 (JP) ..... 2012-175542

(51) Int. Cl.

| | |
|---|---|
| ***H01R 43/033*** | (2006.01) |
| ***H01F 41/06*** | (2016.01) |
| ***H01F 41/098*** | (2016.01) |
| ***H01F 41/076*** | (2016.01) |

(52) U.S. Cl.
CPC ..... *H01F 41/0612* (2013.01); *H01F 41/076* (2016.01); *H01F 41/098* (2016.01); *H01R 43/033* (2013.01)

(58) Field of Classification Search
CPC ..... H01F 41/10; H01F 41/064; H01F 41/076; H01F 41/098; H01R 43/033
See application file for complete search history.

(56) References Cited

U.S. PATENT DOCUMENTS 3,213,894 A * 10/1965 Etchison, Jr. ..... H01R 43/033 242/439.1
3,244,202 A 4/1966 Huang
3,250,302 A 5/1966 Zoltai
(Continued)

FOREIGN PATENT DOCUMENTS

EP 0570007 A2 11/1993
JP S48-12353 B1 4/1973
(Continued)

*Primary Examiner* — Emmanuel M Marcelo
(74) *Attorney, Agent, or Firm* — Rabin & Berdo, P.C.

(57) ABSTRACT

A winding device includes a wire cutting mechanism for cutting the wire wound around the winding target member in the vicinity of the terminal, and a wire binding mechanism for winding, around the terminal, the end portion of the wire wound around the winding target member and cut by the wire cutting mechanism. The wire binding mechanism includes a cylindrical member through which the terminal is insertable, and a rotating mechanism for rotating the cylindrical member about the terminal. A protrusion is formed at a distal end of the cylindrical member so as to protrude in an axial direction of the cylindrical member.

5 Claims, 11 Drawing Sheets

(56) References Cited

U.S. PATENT DOCUMENTS

| | | | | | |
|---|---|---|---|---|---|
| 3,619,819 | A | | 11/1971 | Finn | |
| 3,759,454 | A | * | 9/1973 | Bernard | H01R 43/033 242/439.1 |
| 4,000,764 | A | * | 1/1977 | Reiger, Jr. | H01R 43/033 140/113 |
| 4,111,242 | A | * | 9/1978 | Jacobson | H01R 43/033 140/124 |
| 4,305,435 | A | | 12/1981 | Kaiser | |
| 5,397,070 | A | * | 3/1995 | Yano | H01F 41/076 242/443.1 |
| 2005/0242227 | A1 | * | 11/2005 | Takeda | H01F 41/082 242/476.7 |
| 2009/0231078 | A1 | * | 9/2009 | Watanabe | H01F 5/02 336/192 |
| 2009/0302988 | A1 | * | 12/2009 | Hironaka | H01F 5/04 336/192 |

FOREIGN PATENT DOCUMENTS

| | | | |
|---|---|---|---|
| JP | S55-91812 | A | 7/1980 |
| JP | S57-107017 | A | 7/1982 |
| JP | H02-018915 | A | 1/1990 |
| JP | H05-299283 | A | 11/1993 |
| JP | H05-315179 | A | 11/1993 |
| JP | H07-283065 | A | 10/1995 |
| JP | 2012-080037 | A | 4/2012 |

* cited by examiner

WINDING DEVICE AND METHOD FOR BINDING WIRE MATERIAL TO TERMINAL

TECHNICAL FIELD

The present invention relates to a winding device for binding, around a terminal of a winding target member, an end portion of a wire wound around the winding target member including the terminal, and also relates to a method of binding, around the terminal, the wire wound around the winding target member.

BACKGROUND ART

JP 1995-283065A discloses a winding device for winding, around a rotating winding target member, a wire fed from a nozzle under predetermined tension. In the winding device, before and after the winding, the wire is bound around a terminal provided to the winding target member. The wire bound around the terminal is cut by a cutter or the like, but the tension is always applied to the wire. Accordingly, in order to prevent the wire from being pulled out of the nozzle due to the cutting, it is necessary to retain the wire between the nozzle and a cutting portion. Thus, such a winding machine includes a binding member around which the wire is temporarily bound.

In the above-mentioned winding device, before the start of winding, first, the wire is bound around the binding member. In this state, the nozzle is moved around the terminal, and thus the wire fed from the nozzle is bound around the terminal. After that, the wire extending from the binding member to the terminal is cut in the vicinity of the terminal. At the end of winding, the nozzle is guided from a winding drum of the winding target member to the vicinity of the terminal, and the nozzle is caused to circle around the terminal. Thus, the wire fed from the nozzle is bound around the terminal. After that, the wire extending from the terminal to the nozzle side is cut in the vicinity of the terminal, and thus the wire is wound around the winding target member including the terminal, thereby obtaining a coil in which each end portion of the wire is bound around the terminal.

SUMMARY OF INVENTION

In recent years, along with downsizing of electronic devices, downsizing and higher performance of the coil have increasingly been demanded. In order to meet such demands, the coil is sometimes manufactured using a wire having a large diameter relative to a size of the winding target member. In a case where a relatively small coil is manufactured using the wire having a large diameter, due to rigidity of the wire having a large diameter, a relatively large force acts on the terminal provided to the winding target member. When this large force acts, the terminal provided to the winding target member is tilted to cause breakage of the winding target member on which the terminal is mounted, or cause breakage of the terminal itself, such as bending of the terminal itself. As a result, there is a problem in that it is difficult to bind the wire around the terminal.

The present invention has an object to provide a winding device capable of reliably binding a wire around a terminal without causing breakage of a winding target member or the terminal itself even when the wire has a relatively large diameter, and to provide a method of binding the wire around the terminal.

According to an aspect of the present invention, a winding device includes a chuck capable of gripping a winding target member including a winding drum around which a wire is to be wound, and a terminal around which the wire is to be bound, a nozzle for feeding the wire toward the winding target member, a binding member for locking thereon an end portion of the wire fed from the nozzle, a winding mechanism for rotating the chuck together with the binding member so as to wind the wire fed from the nozzle around the winding target member, a wire cutting mechanism for cutting the wire wound around the winding target member, and a wire binding mechanism for winding, around the terminal, the end portion of the wire wound around the winding target member and cut by the wire cutting mechanism.

DESCRIPTION OF EMBODIMENTS

Now, embodiments of the present invention are described with reference to the accompanying drawings.

Figure 1A:
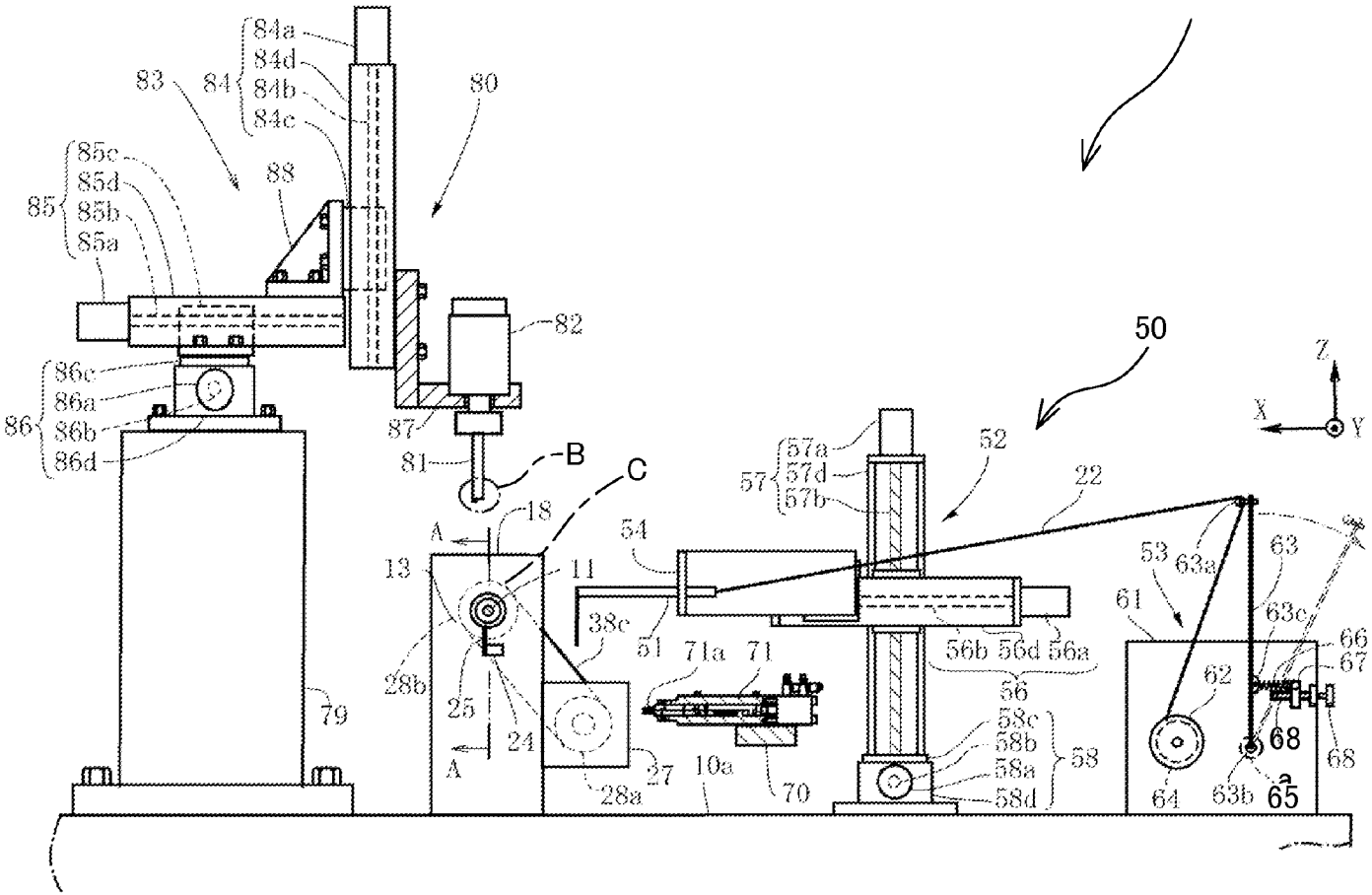
FIG. 1A is a front view illustrating a winding device according to an embodiment of the present invention.
Figure 1B:
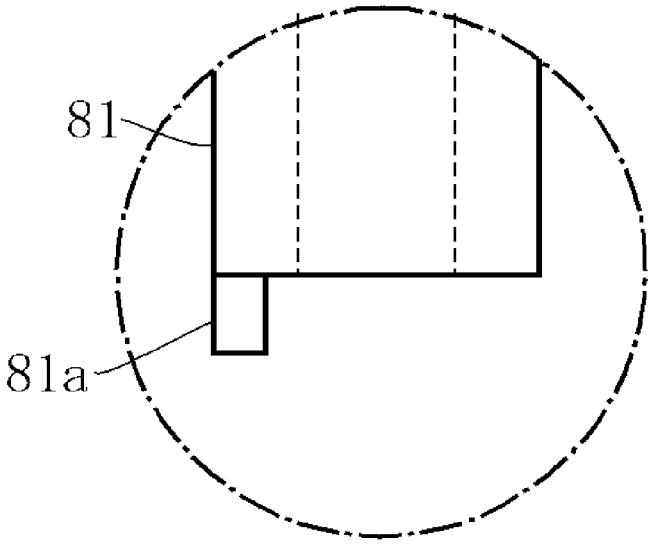
FIG. 1B is an enlarged view illustrating the portion B of FIG. 1A.
Figure 1C:
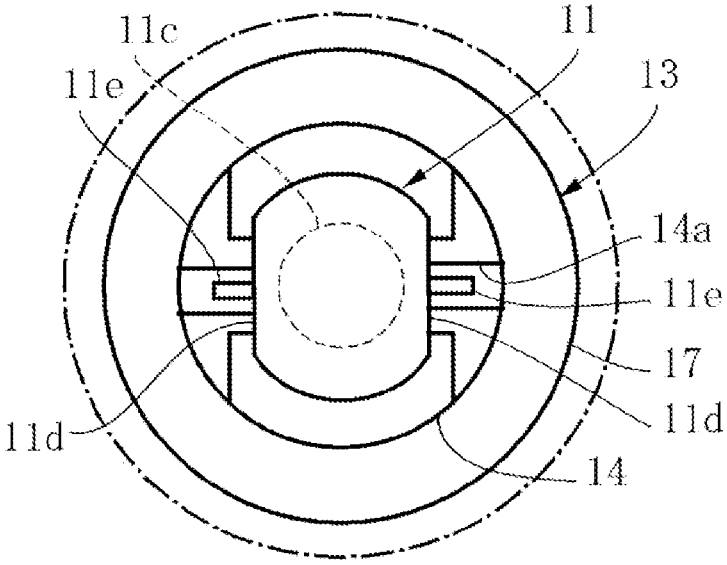
FIG. 1C is an enlarged view illustrating the portion C of FIG. 1A.
Figure 3:
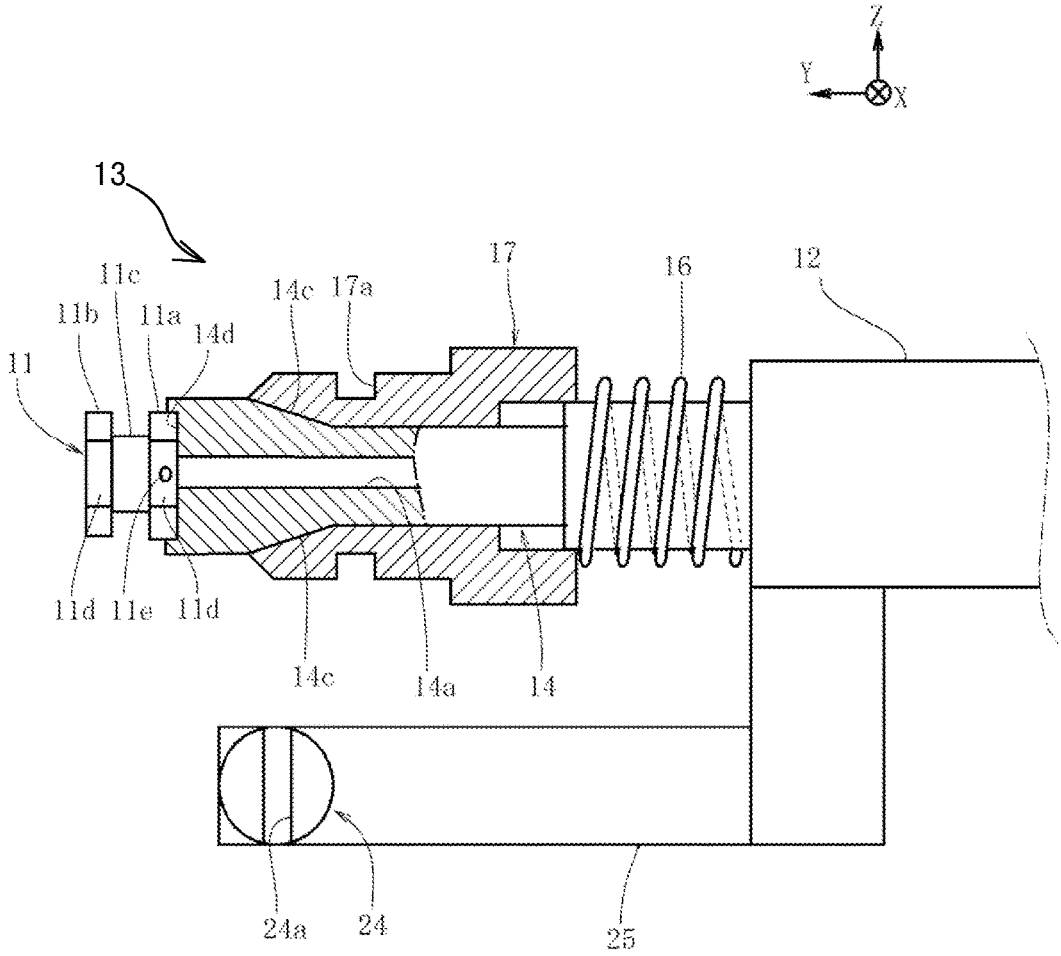
FIG. 3 is a cross-sectional view taken along the line A-A of FIG. 1A.
Figure 4:
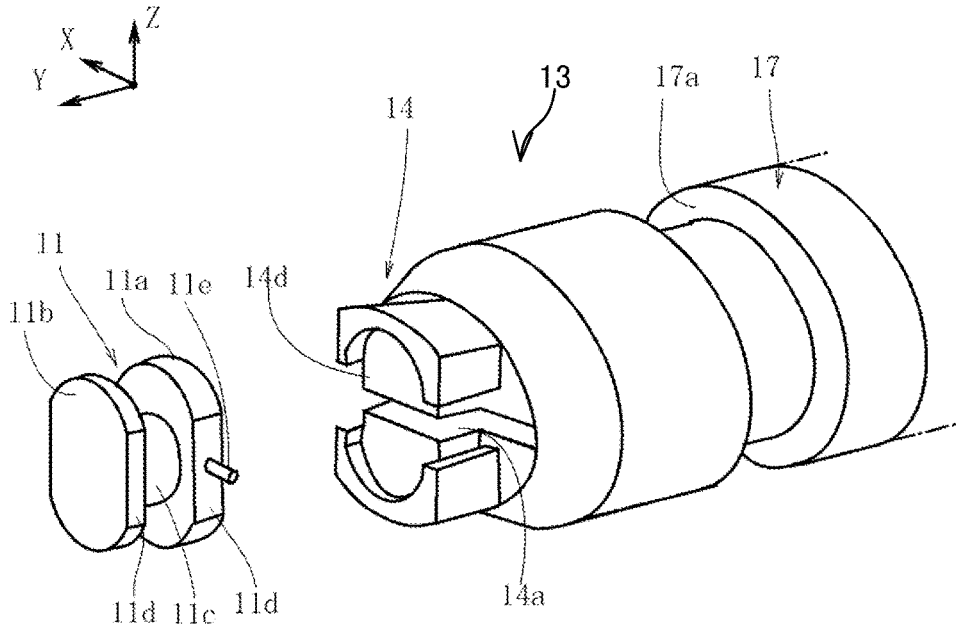
FIG. 4 is a perspective view illustrating a winding target member and a chuck for supporting the winding target member.

FIG. 1A is a view illustrating a winding device according to an embodiment of the present invention. Here, three axes, specifically, X-, Y-, and Z-axes orthogonal to each other, are set. The X-axis extends in a longitudinal direction in a horizontal plane, the Y-axis extends in a transverse direction in the horizontal plane, and the Z-axis extends in a vertical direction. Based on the above-mentioned assumption, a winding device 10 according to the embodiment of the present invention is described. The winding device 10 according to this embodiment includes a chuck 13 capable of mounting thereon a winding target member 11 around which a wire is to be wound. As illustrated in FIG. 3 and FIG. 4, the winding target member 11 is made of an insulating material such as a dielectric material, a magnetic material, insulating ceramics, and plastics, and serves as a so-called chip component core in which flange portions 11*a*, 11*b* are formed on both end portions of a winding drum 11*c*, respectively. The winding drum 11*c* of the winding target member 11 has a circular cross-section. Each of the flange portions 11*a*, 11*b* formed on the both end portions of the winding target member 11 has a circular contour, and includes flat surface portions 11*d* that are formed to be parallel and opposed to each other. On each of the mutually-parallel flat surface portions 11*d* of the flange portion 11*a* on one side, a terminal 11*e* is provided so as to protrude outward, whereas the terminal 11*e* is not provided on the flange portion 11*b* on another side. The chuck 13 grips the flange portion 11*a* on one side of the winding target member 11.

As illustrated in FIG. 3, the chuck 13 is provided on an end portion of a spindle 12 that extends in the Y-axis direction in horizontal posture. The chuck 13 includes a chuck body 14 provided at a distal end of the spindle 12 so that a base end of the chuck body 14 is coaxial with the spindle 12, and a chuck opening/closing member 17 that is fitted on an outer periphery of the chuck body 14 and elastically supported by a spring 16 for chuck in an axial direction of the chuck body 14. As illustrated in FIG. 3 and FIG. 4, in the chuck body 14, a slit 14*a* is formed to extend from a distal end of the chuck body 14 along a center axis thereof in the axial direction. The distal end of the chuck body 14 is divided into two pieces by the slit 14*a*. On an outer periphery of each of the divided pieces of the chuck body 14, there is formed a tapered surface 14*c* having an outer diameter decreased toward the spindle 12. A recessed portion 14*d* for receiving the flange portion 11*a* on one side of the winding target member 11 is formed in an edge of the distal end of the chuck body 14 so as to extend across the slit 14*a*. A peripheral wall of the recessed portion 14*d* is formed in conformity to the contour of the flange portion 11*a* on one side.

As illustrated in FIG. 3, the chuck opening/closing member 17 fitted on the outer periphery of the chuck body 14 is formed into a cylindrical shape, and is configured so that an inner periphery thereof is held in slide-contact with the tapered surface 14*c* of each of the divided pieces of the chuck body 14. In the outer periphery of the chuck opening/closing member 17, there is formed a recessed groove 17*a* in which a chuck opening/closing mechanism (not shown) is engaged. The chuck opening/closing member 17, which is biased by the spring 16 for chuck in a direction of separating from the spindle 12, presses the tapered surfaces 14*c* of the chuck body 14 in the same direction as the separating direction. In this manner, an interval between the divided pieces of the distal end of the chuck body 14 divided by the slit 14*a* is narrowed, and hence the chuck body 14 grips the flange portion 11*a* on one side of the winding target member 11 received in the recessed portion 14*d* of the distal end of the chuck body 14. Further, as illustrated in FIG. 5, the flange portion 11*a* on one side of the winding target member 11 is gripped in a state in which a center axis of the winding target member 11 is coaxial with a center axis of the chuck 13.

Figure 5:
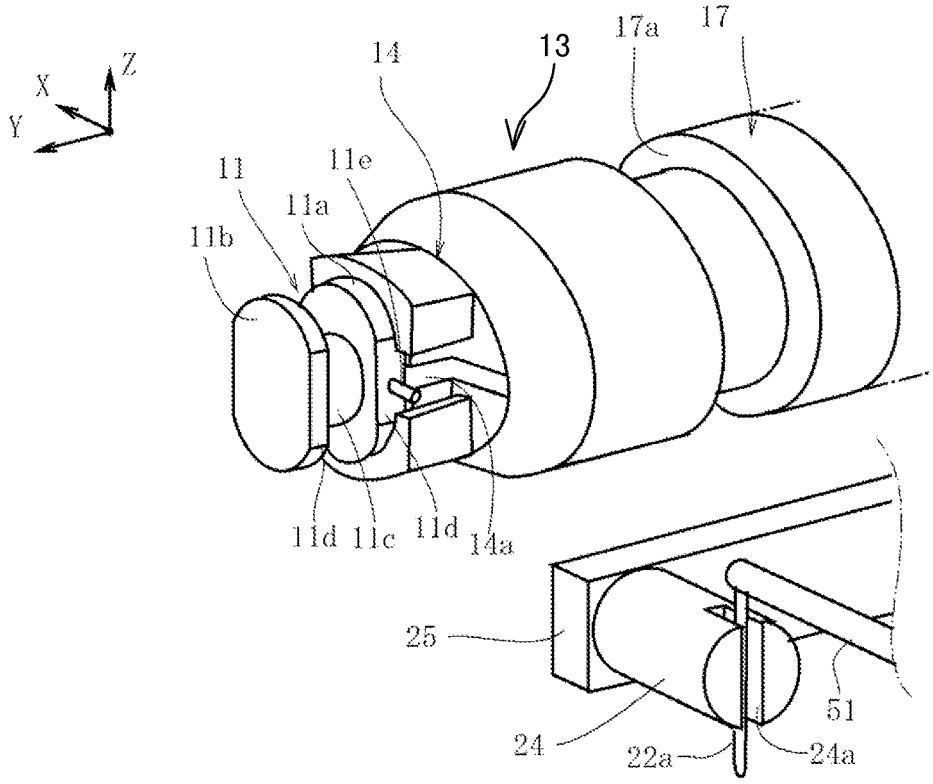
FIG. 5 is a perspective view illustrating a state in which the winding target member is supported by the chuck.

A binding member 24 is provided to the spindle 12 having the chuck 13 provided at the distal end thereof (see FIG. 5). The binding member 24 temporarily locks thereon an end portion of a wire 22 fed from a nozzle 51 described below. The wire 22 according to this embodiment is formed of an insulated conducting wire including a conducting wire made of Cu, and an insulated coating formed to coat an outer peripheral surface of the conducting wire. The binding member 24 is formed into a columnar shape, and a groove 24*a* is formed in the distal end of the binding member 24 to extend in a diameter direction of the binding member 24. The groove 24*a* has a width enabling a wire 22*a* at the start of winding to be received therein. The binding member 24 is provided to the spindle 12 via an L-shaped mounting member 25.

Figure 2:
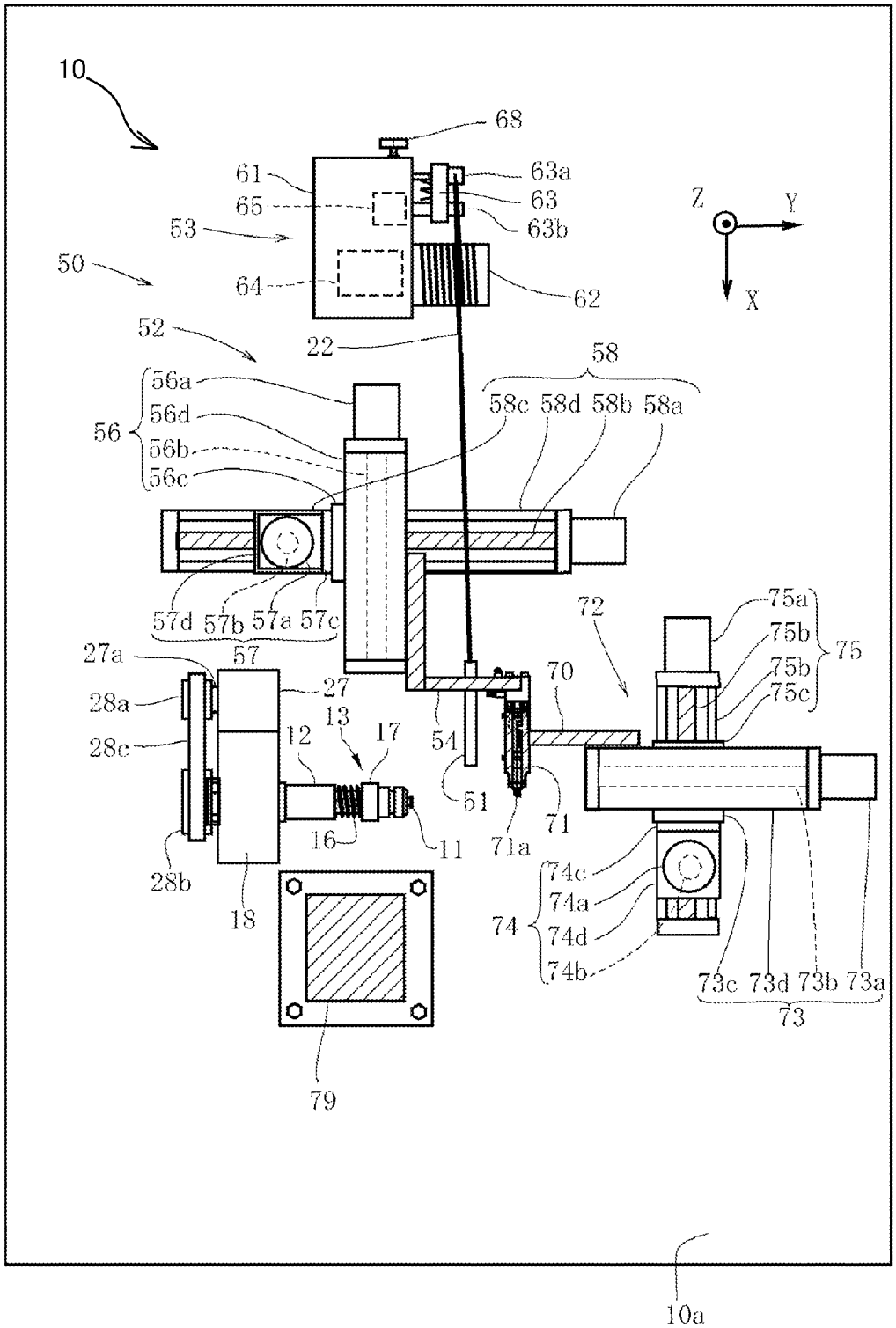
FIG. 2 is a top view illustrating the winding device according to the embodiment of the present invention.

As illustrated in FIG. 2, the chuck 13 is coaxially provided at the distal end of the spindle 12, and the spindle 12 is supported on a base 18 so as to be rotatable about a center axis thereof. The base 18 supporting the spindle 12 thereon is fixed on a pedestal 10*a*. A servomotor 27 is mounted on the base 18. The servomotor 27 serves as a winding mechanism for rotating the spindle 12 together with the binding member 24. A pulley 28*a* and a pulley 28*b* are provided to a rotary shaft 27*a* of the servomotor 27 and the spindle 12, respectively, and a belt 28*c* is looped around the pulley 28*a* and the pulley 28*b*. When the servomotor 27 is driven so that the rotary shaft 27*a* is rotated, the rotation is transmitted to the spindle 12 through the belt 28*c*. In this manner, the spindle 12 is rotated together with the binding member 24. Further, although not shown, the chuck opening/closing mechanism for operating the chuck 13 is provided on the pedestal 10*a*.

As illustrated in FIGS. 1A and 2, a wire feeding machine 50, which feeds the wire 22, is provided on the pedestal 10*a*. The wire feeding machine 50 includes the nozzle 51, a nozzle moving mechanism 52, and a tension device 53. The wire 22 passes through the nozzle 51. The nozzle moving mechanism 52 moves the nozzle 51 in three axial directions. The tension device 53 applies a tension to the wire 22. The nozzle 51 is fixed to a support plate 54.

The nozzle moving mechanism 52 is capable of moving the support plate 54 in the three axial directions with respect to the pedestal 10*a*. The nozzle moving mechanism 52 of this embodiment includes a combination of an X-axis direction telescopic actuator 56, a Y-axis direction telescopic actuator 58, and a Z-axis direction telescopic actuator 57. The telescopic actuators 56 to 58 that construct the nozzle moving mechanism 52 include housings 56*d* to 58*d*, ball screws 56*b* to 58*b*, followers 56*c* to 58*c*, and the like. The housings 56*d* to 58*d* have an elongated box-like shape. The ball screws 56*b* to 58*b* are provided inside the housing 56*d* to 58*d* so as to extend in the longitudinal direction, and are rotationally driven by servomotors 56*a* to 58*a*. The followers 56*c* to 58*c* are screwed with the ball screws 56*b* to 58*b* to move in parallel. In the telescopic actuators 56 to 58, when the servomotors 56*a* to 58*a* are driven to rotate the ball screws 56*b* to 58*b*, the followers 56*c* to 58*c* screwed with the ball screws 56*b* to 58*b* move along the longitudinal direction of the housings 56*d* to 58*d*.

In this embodiment, the support plate 54 through which the nozzle 51 is provided is mounted to the housing 56*d* of the X-axis direction telescopic actuator 56 so as to be movable in the X-axis direction. The follower 56*c* of the X-axis direction telescopic actuator 56 is mounted to the follower 57*c* of the Z-axis direction telescopic actuator 57 so as to enable the support plate 54 to move in the Z-axis direction together with the X-axis direction telescopic actuator 56. Further, the housing 57*d* of the Z-axis direction telescopic actuator 57 is mounted to the follower 58*c* of the Y-axis direction telescopic actuator 58 so as to enable the support plate 54 to move in the Y-axis direction together with the X-axis direction telescopic actuator 56 and the Z-axis direction telescopic actuator 57. The housing 58*d* of the Y-axis direction telescopic actuator 58 extends in the Y-axis direction to be fixed on the pedestal 10*a*. The servomotors 56*a* to 58*a* of the respective telescopic actuators 56 to 58 are connected to a control output of a controller (not shown) for controlling the servomotors 56*a* to 58*a*.

The tension device 53 can apply a tension to the fed wire 22 and pull back the wire 22. The tension device 53 includes a casing 61, a drum 62, and a tension bar 63. The casing 61 is provided to the pedestal 10*a*. The drum 62 and the tension bar 63 are provided on a side surface of the casing 61 in the Y-axis direction. The wire 22 is wound around the drum 62. Inside the casing 61, a feeding control motor 64 for rotating the drum 62 to feed the wire 22 is provided. The wire 22 fed from the drum 62 is guided by a wire guide 63*a* provided to a distal end of the tension bar 63. The wire 22 guided by the wire guide 63*a* passes from the wire guide 63*a* through the nozzle 51 to be wired.

The tension bar 63 is turnable in the X-axis direction about a turning shaft 63*b* at a base end as a fulcrum. An angle of turning of the turning shaft 63*b* is detected by a potentiometer 65. The potentiometer 65 is provided as a turning angle detection mechanism that is received in the casing 61, and is mounted to the turning shaft 63*b*. A detection output of the potentiometer 65 is input to the controller (not shown). A control output from the controller is connected to the feeding control motor 64.

As illustrated in FIG. 1A, a spring 66 serving as a biasing mechanism is mounted at a predetermined position between the turning shaft 63*b* of the tension bar 63 and the wire guide 63*a*. The spring 66 is provided as the elastic member for applying a biasing force in a direction of turning of the tension bar 63. One end of the spring 66 is mounted between the turning shaft 63*b* and the wire guide 63*a* via a mounting bracket 63*c*. Accordingly, the elastic force in accordance with the turning angle is applied to the tension bar 63 by the spring 66 serving as the elastic member. Another end of the spring 66 is fixed to a moving member 67. The moving member 67 is screwed with a male screw 68*a* of a tension adjusting screw 68, and movement of the moving member 67 can be adjusted along with rotation of the male screw 68*a*. In this manner, the fixed position of the another end of the spring 66 is displaced, and thus the tension to be applied on the wire 22 can be adjusted by the tension bar 63.

The controller (not shown) controls the feeding control motor 64 so that the turning angle detected by the potentiometer 65 serving as the turning angle detection mechanism becomes equal to a predetermined angle. Therefore, the tension device 53 applies the tension to the wire 22 by the spring 66 through the tension bar 63 to rotate the drum 62 so that the turning angle of the tension bar 63 becomes a predetermined angle. In this manner, a predetermined amount of the wire 22 is fed. Thus, the tension of the wire 22 is maintained to a predetermined value.

As illustrated in FIG. 2, besides the nozzle 51, a nipper clamp device 71 (see JP 2011-217824 A) is mounted on the pedestal 10*a* via a cutter moving mechanism 72. The nipper clamp device 71 cuts the wire 22 passing through the nozzle 51 with air pressure. The nipper clamp device 71 cuts the wire 22, and retains one of cut pieces of the wire 22. The nipper clamp device 71 is mounted on a mounting plate 70. Similarly to the above-mentioned nozzle moving mechanism 52, the cutter moving mechanism 72 for moving the nipper clamp device 71 includes a combination of a Y-axis direction telescopic actuator 73, a Z-axis direction telescopic actuator 74, and an X-axis direction telescopic actuator 75.

In this embodiment, the nipper clamp device 71 is provided with the mounting plate 70. The mounting plate 70 is mounted to a housing 73*d* of the Y-axis direction telescopic actuator 73 so as to be movable in the Y-axis direction. A follower 73*c* of the Y-axis direction telescopic actuator 73 is mounted to a follower 74*c* of the Z-axis direction telescopic actuator 74 so as to enable the mounting plate 70 to move in the Z-axis direction together with the Y-axis direction telescopic actuator 73. Further, a housing 74*d* of the Z-axis direction telescopic actuator 74 is mounted to a follower 75*c* of the X-axis direction telescopic actuator 75 so as to enable the mounting plate 70 to move in the X-axis direction together with the Y-axis direction telescopic actuator 73 and the Z-axis direction telescopic actuator 74. A housing 75*d* of the X-axis direction telescopic actuator 75 extends in the X-axis direction to be fixed on the pedestal 10*a*. Servomotors 73*a* to 75*a* of the respective telescopic actuators 73 to 75 are connected to the control output of the controller (not shown) for controlling the servomotors 73*a* to 75*a*.

With this configuration, the cutter moving mechanism 72 can move the nipper clamp device 71 in three axial directions with respect to the pedestal 10*a*. The nipper clamp device 71 can be moved by the cutter moving mechanism 72 between a cutting position at which cutter blades 71*a* cut the wire 22 and a waiting position at which the cutter blades are separated away from the wire 22. The nipper clamp device 71 is moved by the cutter moving mechanism 72 independently of the nozzle 51, and can be controlled by the controller (not shown).

As illustrated in FIG. 1A, the winding device 10 includes a wire binding mechanism 80 for binding, around the terminal 11*e*, the end portion of the wire 22 wound around the winding target member 11 and cut by the nipper clamp device 71 serving as a wire cutting mechanism. The wire binding mechanism 80 includes a cylindrical member 81 into which the terminal 11*e* can be inserted, and a binding servomotor 82 serving as a rotating mechanism for rotating the cylindrical member 81 about the terminal 11*e*. A column 79 is provided upright on the pedestal 10*a* in the vicinity of the base 18. The binding servomotor 82 is provided above the column 79 via a motor moving mechanism 83 so that a rotary shaft 82*a* is directed vertically downward. Similarly to the nozzle moving mechanism 52 and the cutter moving mechanism 72 described above, the motor moving mechanism 83 includes a combination of a Z-axis direction telescopic actuator 84, an X-axis direction telescopic actuator 85, and a Y-axis direction telescopic actuator 86.

In this embodiment, a mounting piece 87 on which the binding servomotor 82 is mounted is mounted to a housing 84*d* of the Z-axis direction telescopic actuator 84 so as to be movable in the Z-axis direction. A follower 84*c* of the Z-axis direction telescopic actuator 84 is mounted to a housing 85*d* of the X-axis direction telescopic actuator 85 via an angle member 88 so as to enable the mounting piece 87 to move in the X-axis direction together with the Z-axis direction telescopic actuator 84. Further, a follower 85*c* of the X-axis direction telescopic actuator 85 is mounted to a follower 86*c* of the Y-axis direction telescopic actuator 86 so as to enable the mounting piece 87 to move in the Y-axis direction together with the Z-axis direction telescopic actuator 84 and the X-axis direction telescopic actuator 85. A housing 86*d* of the Y-axis direction telescopic actuator 86 extends in the Y-axis direction to be fixed on top of the column 79. Servomotors 84*a* to 86*a* of the respective telescopic actuators 84 to 86 are connected to the control output of the controller (not shown) for controlling the servomotors 84*a* to 86*a*. With this configuration, the motor moving mechanism 83 can move the binding servomotor 82 in three axial directions with respect to the pedestal 10*a*.

Figure 10:
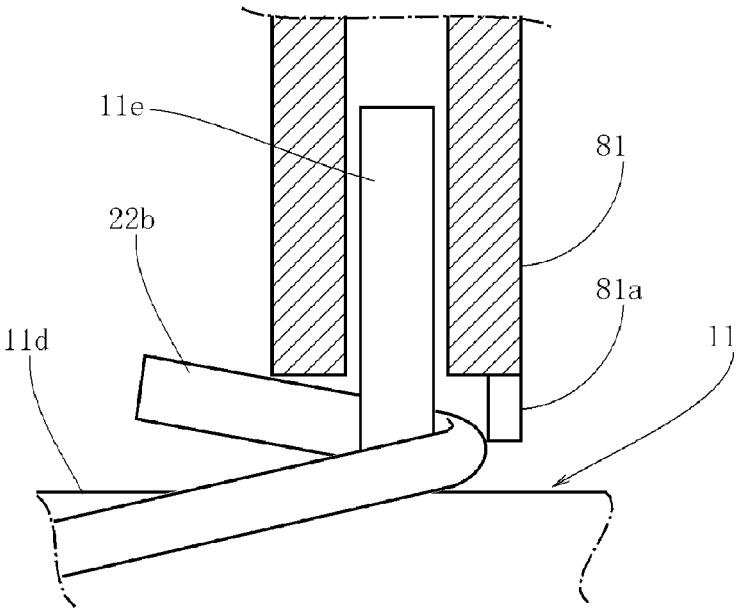
FIG. 10 is an enlarged cross-sectional view illustrating a state in which the terminal is inserted into the cylindrical member.
Figure 14:
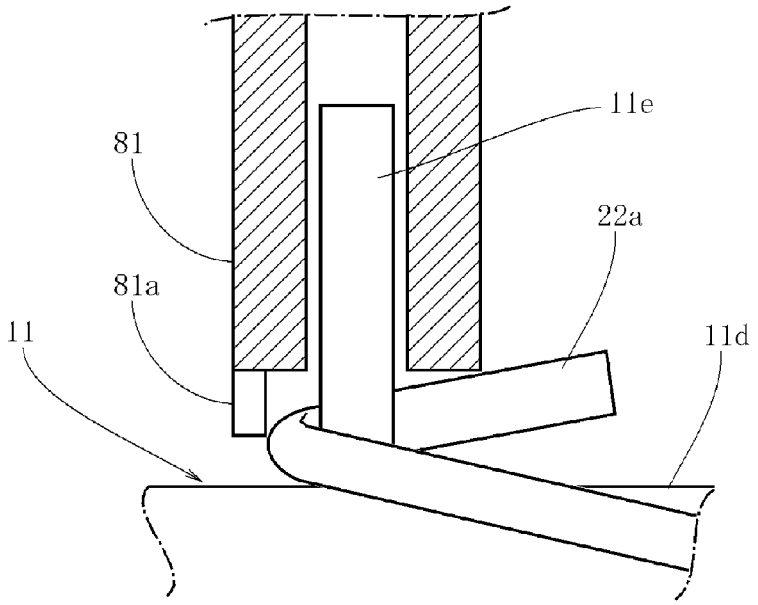
FIG. 14 is an enlarged cross-sectional view illustrating a state in which the terminal is inserted into the cylindrical member.

The cylindrical member 81 having a circular cross-section is coaxially provided on the rotary shaft 82*a* of the binding servomotor 82. The cylindrical member 81 has an inner diameter enabling the terminal 11*e* to be inserted into the cylindrical member 81. On a part in a peripheral direction of the distal end of the cylindrical member 81, a protrusion 81*a* protruding from the distal end of the cylindrical member 81 is formed. As illustrated in FIG. 10 and FIG. 14, the protrusion 81*a* is formed so as to sandwich, together with the terminal 11*e*, the wire 22 bound along the terminal 11*e* in a state in which the terminal 11*e* is inserted into the cylindrical member 81. Further, in this embodiment in which the pin-like terminal 11*e* having a circular cross-section is used, the protrusion 81*a* is formed so that an outer periphery thereof is continuous with the outer periphery of the cylindrical member 81. In other words, in order to sandwich the wire 22 together with the terminal 11*e*, the protrusion 81*a* is formed at a position distant from the inner periphery of the cylindrical member 81. Accordingly, when the cylindrical member 81 is rotated about the terminal 11*e*, the protrusion 81*a* circles about the terminal 11*e* together with the cylindrical member 81, to thereby cause the wire 22 sandwiched between the protrusion 81*a* and the terminal 11*e* to circle around the terminal 11*e*. At this time, the protrusion 81*a* is formed to have a circular cross-section, and hence is prevented from damaging the wire 22 that is brought into abutment against and rubbed against the periphery of the protrusion 81*a*.

Next, winding procedures performed using the above-mentioned winding device are described.

First, as illustrated in FIG. 5, the flange portion 11*a* on one side of the winding target member 11 is gripped by the chuck 13. The flange portion 11*a* on one side of the winding target member 11 is received in the recessed portion 14*d* (see FIG. 4) formed in the distal end of the chuck 13. In this state, the chuck opening/closing member 17 is moved by the biasing force of the spring 16 for chuck toward the distal end of the chuck 13, to thereby narrow the interval between the divided pieces of the distal end of the chuck 13 divided by the slit 14*a*. In this manner, the flange portion 11*a* on one side of the winding target member 11 received in the recessed portion 14*d* formed in the distal end of the chuck 13 is gripped by the chuck 13.

Next, the wire 22 is fed from the nozzle 51 extending horizontally in the X-axis direction, and then is bent downward. The end portion of the wire 22 fed from the nozzle 51 is locked as the wire 22*a* at the start of winding on the binding member 24.

Figure 6:
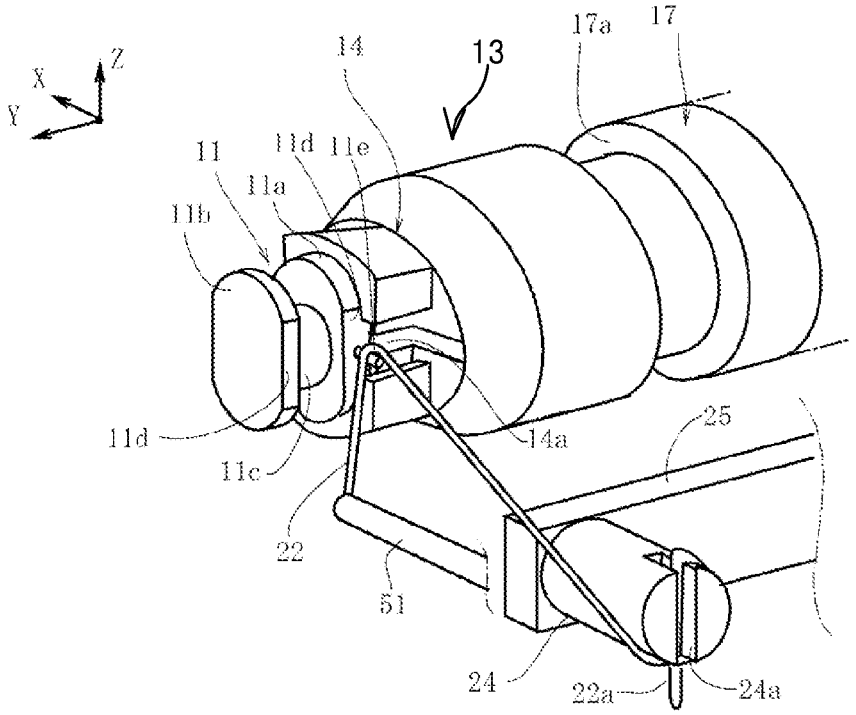
FIG. 6 is a perspective view illustrating a state in which a wire at the start of winding is locked on a terminal of the winding target member.

The wire 22 being the wire 22*a* at the start of winding is locked on the binding member 24 in such a manner that the nozzle 51 is moved by the nozzle moving mechanism 52 (see FIG. 1A). Specifically, as illustrated in FIG. 5, the nozzle 51 is moved, and the wire 22*a* at the start of winding, which is bent downward from the distal end of the nozzle 51, is inserted through the groove 24*a* of the binding member 24. Then, as illustrated in FIG. 6, after the nozzle 51 is caused to circle around the binding member 24, the nozzle 51 is moved so as to turn back at the terminal 11*e* of the winding target member 11. In this manner, the end portion of the wire 22 fed from the nozzle 51 is locked on the binding member 24, and a subsequent portion of the wire 22 fed from the nozzle 51 is locked on the terminal 11*e*.

Figure 7:
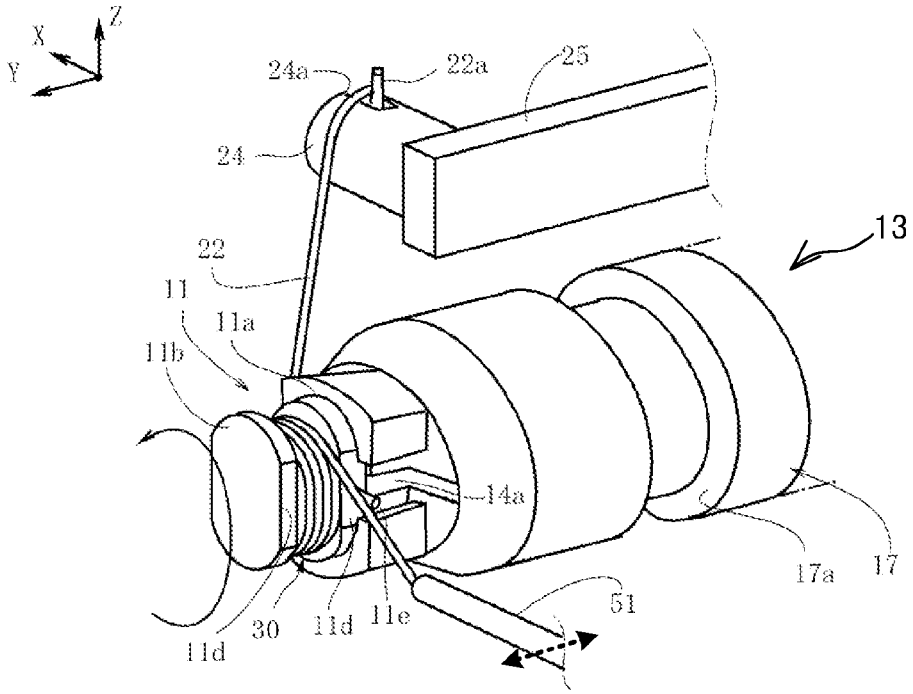
FIG. 7 is a perspective view illustrating a state in which a wire is wound around the winding target member.

After that, the binding member 24 and the chuck 13 are rotated in synchronization with each other in the same direction by the servomotor 27 (see FIG. 2). Thus, the wire 22 fed from the nozzle 51 is wound around the winding drum 11*c* of the winding target member 11 that is rotated together with the chuck 13 in an arrow direction indicated by the solid line of FIG. 7, thereby obtaining a coil 30. At this time, it is preferred that the nozzle 51 be reciprocated within a range of a width of the winding drum 11*c*. Every time the chuck 13 makes one revolution together with the winding target member 11, the nozzle 51 is moved by an amount equal to a wire diameter of the wire 22. In this manner, the wire 22 fed from the nozzle 51 can be wound around the winding drum 11*c* regularly in a close contact state. Accordingly, so-called regular winding of the wire 22 can be performed. As illustrated in FIG. 7, at a stage of winding the wire 22 a predetermined number of turns, rotation of the winding target member 11 is stopped in a state in which the terminal 11*e* around which a wire 22*b* at the end of winding is to be bound is directed to the nozzle 51.

Figure 8:
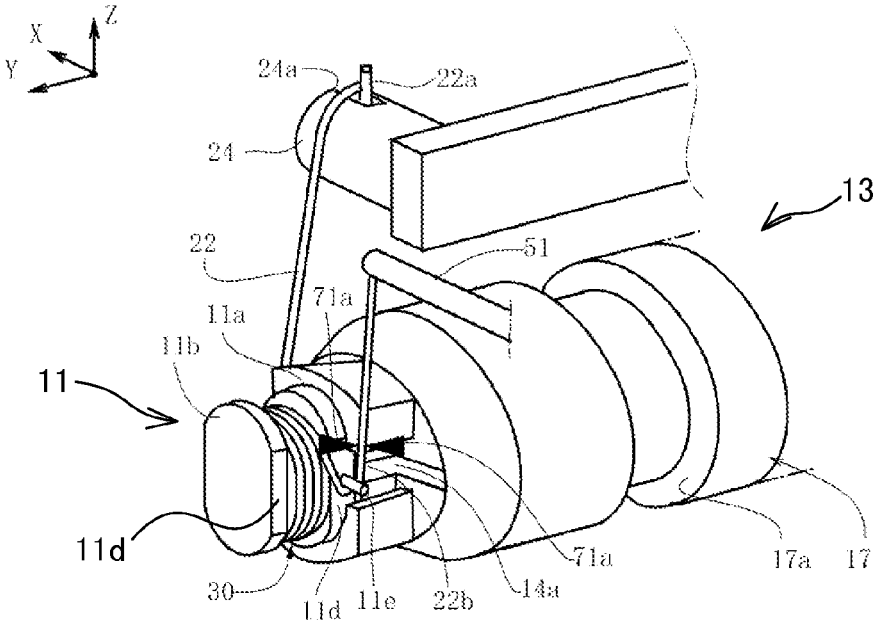
FIG. 8 is a perspective view illustrating a state in which a wire at the end of winding is locked on another terminal of the winding target member.

Next, as illustrated in FIG. 8, the nozzle 51 is moved by the nozzle moving mechanism 52 so as to turn back at the terminal 11*e* of the winding target member 11, and is caused to wait above the winding target member 11. In this manner, a portion of the wire 22 fed from the nozzle 51 after winding is locked on the terminal 11*e* for the end of winding. Then, the nipper clamp device 71 is moved by the cutter moving mechanism 72 (see FIG. 2), and the cutter blades 71*a*, 71*a* nip the wire 22 in the vicinity of the terminal 11*e*. The cutter blades 71*a*, 71*a* are closed by the nipper clamp device 71 in the vicinity of the terminal 11*e*, to thereby cut the wire 22 between the terminal 11*e* and the nozzle 51 in a state in which a portion of the wire 22 having a length long enough to be bound around the terminal 11*e* is left in the vicinity of the terminal 11*e*. At this time, the wire 22 is prone to be returned by the tension device 53 (see FIG. 1A) to the tension device 53 side. However, the wire 22 fed from the nozzle 51 extending horizontally is bent downward, and hence the wire 22 is locked on an edge of a hole of the nozzle 51, with the result that the return of the wire 22 is prevented. In addition, the wire 22 is bent downward, and thus next winding can be prepared.

Figure 9:
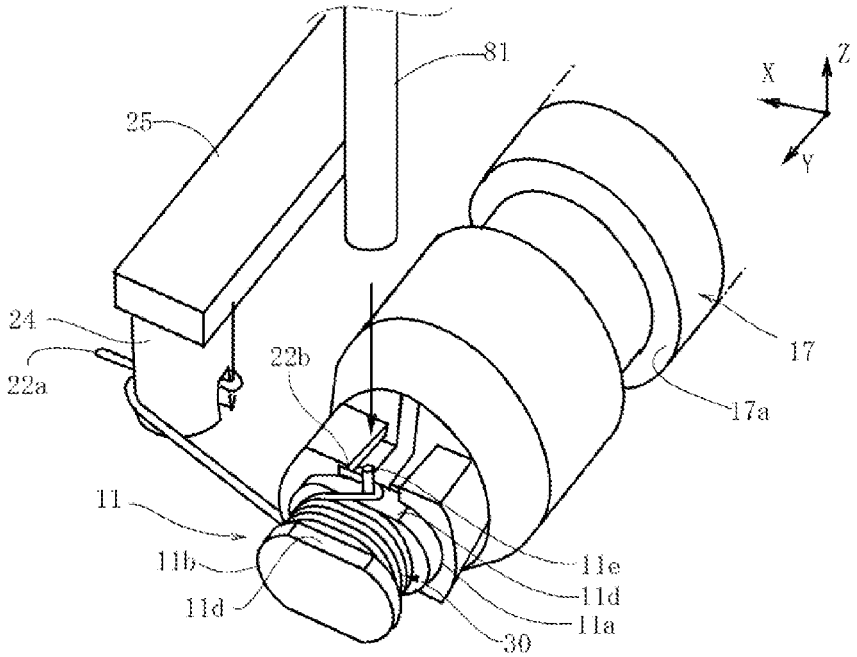
FIG. 9 is a perspective view illustrating a state in which the terminal of the winding target member is opposed to a cylindrical member.

Next, the wire 22*b* at the end of winding, which is formed by cutting by the nipper clamp device 71 and is the wire 22 wound around and drawn from the winding drum 11*c*, is bound around the terminal 11*e*. This binding is performed by wire binding means 80. For this binding, first, the servomotor 27 slightly rotates the spindle 12, and as illustrated in FIG. 9, the terminal 11*e* is directed upward so as to be opposed to the cylindrical member 81. In this state, the terminal 11*e* and the cylindrical member 81 are moved relative to each other so that the terminal 11*e* is inserted into the cylindrical member 81. In other words, in this embodiment, the motor moving mechanism 83 moves the binding servomotor 82, to thereby lower the cylindrical member 81 coaxially provided on the rotary shaft 82*a*. The cylindrical member 81 is lowered, and thus the terminal 11*e* is inserted into the cylindrical member 81. Then, as illustrated in FIG. 10, the protrusion 81*a* is brought into abutment against an outer side of the wire 22 locked on the terminal 11*e*.

Figure 11:
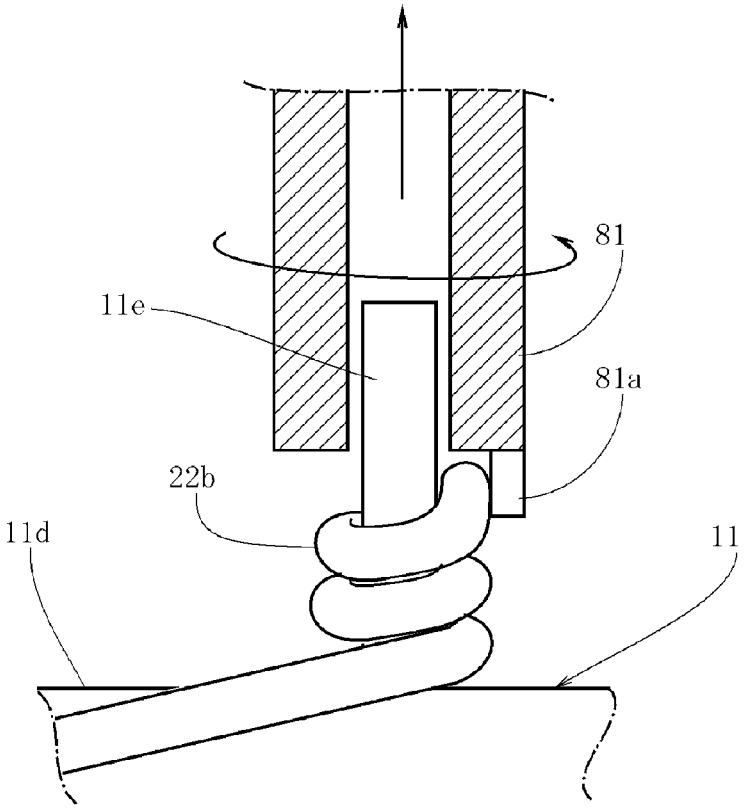
FIG. 11 is an enlarged cross-sectional view illustrating a state in which the cylindrical member, into which the terminal is inserted, is rotated to bind the wire at the end of winding around the terminal.

Next, as illustrated in FIG. 11, the cylindrical member 81 is rotated by the binding servomotor 82 about the terminal 11*e*. The protrusion 81*a*, which is brought into abutment against the outer side of the wire 22 locked on the terminal 11*e*, circles around the terminal 11*e* together with the cylindrical member 81, to thereby bind, around the terminal 11*e*, the wire 22*b* at the end of winding, which is looped around the terminal 11*e*. At this time, it is preferred that, every time the wire 22*b* at the end of winding is wound around the terminal 11*e* one turn, the cylindrical member 81 be moved upward by an amount corresponding to the outer diameter of the wire 22 and the wire 22*b* at the end of winding be wound around the terminal 11*e* in the axial direction in a spiral manner. In this way, the wire 22*b* at the end of winding is bound around the terminal 11*e*. After the binding of the wire 22*b* at the end of winding is finished, the cylindrical member 81 is moved upward by the motor moving mechanism 83 together with the binding servomotor 82, and thus the terminal 11*e* and the cylindrical member 81 are moved relative to each other in separate directions. Thus, the terminal 11*e* is pulled out of the cylindrical member 81.

Figure 12:
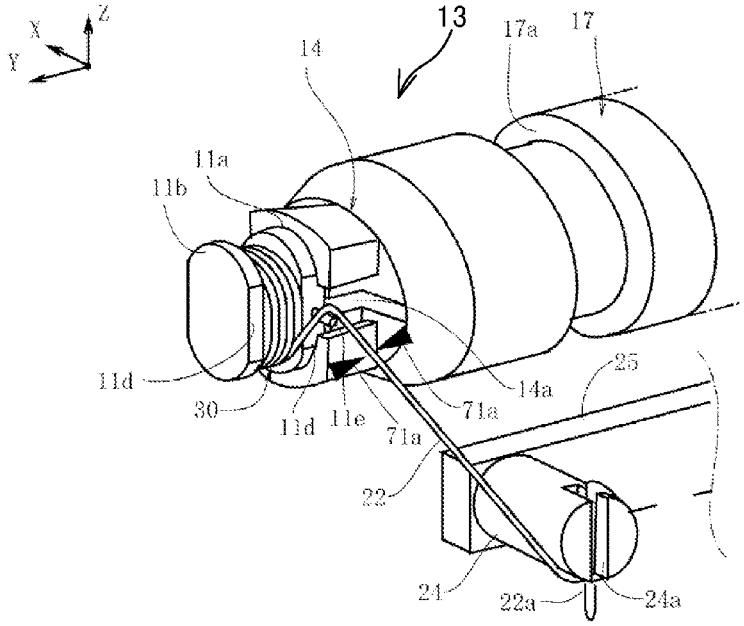
FIG. 12 is a perspective view illustrating a state of cutting the wire at the start of winding, which is locked on the terminal of the winding target member.

Next, the winding start wire 22, which is bound around the binding member 24, is bound around the terminal 11*e*. First, as illustrated in FIG. 12, the spindle 12 is slightly rotated by the servomotor 27 in the reverse direction, and thus the terminal 11*e* is directed to the nozzle 51 side. After that, the nipper clamp device 71 is moved by the cutter moving mechanism 72 so as to cause the cutter blades 71*a* to nip the wire 22 in the vicinity of the terminal 11*e*. The cutter blades 71*a*, 71*a* are closed by the nipper clamp device 71 in the vicinity of the terminal 11*e*, to thereby cut the wire 22 between the terminal 11*e* and the binding member 24 in a state in which the portion of the wire 22 having the length long enough to be bound around the terminal 11*e* is left in the vicinity of the terminal 11*e*. After that, although not shown, in a state in which the nipper clamp device 71 grips the wire 22 left on the binding member 24, the cutter moving mechanism 72 removes the wire 22 from the binding member 24. The cutter moving mechanism 72 moves to a wire receiving box, and puts the removed wire 22 into the wire receiving box.

Figure 13:
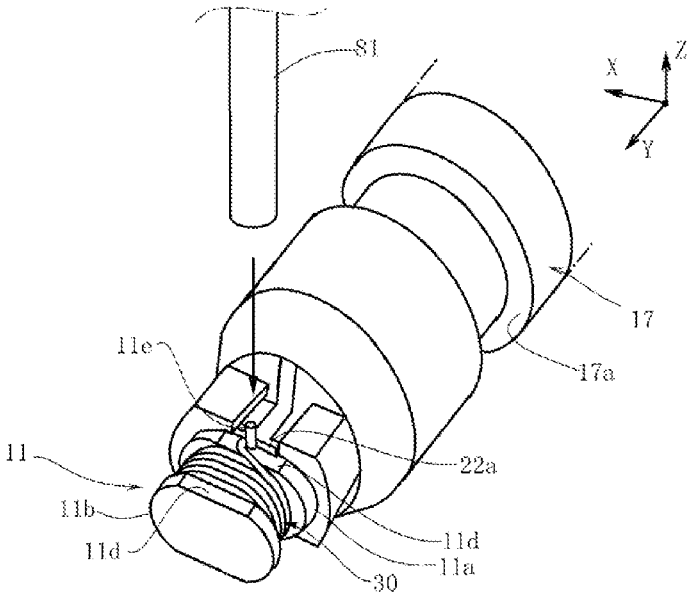
FIG. 13 is a perspective view illustrating a state in which the terminal on which the wire at the start of winding is locked is opposed to the cylindrical member.
Figure 15:
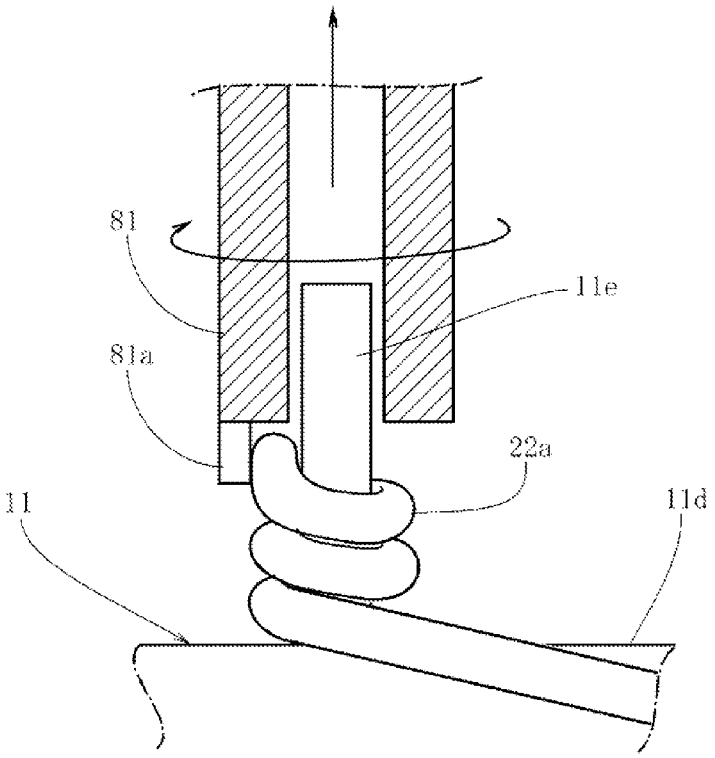
FIG. 15 is an enlarged cross-sectional view illustrating a state in which the cylindrical member, into which the terminal is inserted, is rotated to bind the wire at the start of winding around the terminal.

Then, as illustrated in FIG. 13, the spindle 12 is slightly rotated again, and thus the terminal 11*e* around which the wire 22*a* at the start of winding is looped is directed upward so as to be opposed to the cylindrical member 81. In this state, the motor moving mechanism 83 moves the binding servomotor 82, to thereby lower the cylindrical member 81 provided coaxially on the rotary shaft 82*a*. The cylindrical member 81 is lowered, and thus as illustrated in FIG. 14, the terminal 11*e* is inserted into the cylindrical member 81. After that, as illustrated in FIG. 15, the cylindrical member 81 is rotated about the terminal 11*e*, and the protrusion 81*a* is brought into abutment against the outer side of the wire 22 locked on the terminal 11*e*. In addition, the cylindrical member 81 is rotated together with the protrusion 81*a*, and thus the protrusion 81*a* is caused to circle around the terminal 11*e*. In this manner, the end portion of the wire 22 looped around the terminal 11*e* is bound around the terminal 11*e*.

At this time, it is preferred that, every time the wire 22*a* at the start of winding is wound around the terminal 11*e* one turn, the cylindrical member 81 be moved upward by an amount corresponding to the outer diameter of the wire 22 and the wire 22*a* at the start of winding be wound around the terminal 11*e* in the axial direction in a spiral manner. In this way, the wire 22*a* at the start of winding is bound around the terminal 11*e*. After this binding is finished, the cylindrical member 81 is moved upward by the motor moving mechanism 83 together with the binding servomotor 82, and thus the terminal 11*e* is pulled out of the cylindrical member 81.

Each of the wire 22*a* at the start of winding and the wire 22*b* at the end of winding, which is bound around the terminal 11*e* in the above-mentioned manner, is electrically connected to the terminal 11*e*. Those wires can be connected by a well-known related-art general method, such as soldering using flux (JP 2009-142839 A). As described above, each of the wire 22*a* at the start of winding and the wire 22*b* at the end of winding is connected to the terminal 11*e*, and thus it is possible to obtain a chip coil including the winding target member 11, and the coil 30 formed by winding the wire 22 around the winding target member 11*a* predetermined number of turns.

According to this embodiment, the terminal 11*e* is inserted into the cylindrical member 81, and the cylindrical member 81 is rotated about the terminal 11*e*. Accordingly, the cylindrical member 81 can prevent tilting of the terminal 11*e*. This prevents breakage of the winding target member 11 or the terminal 11*e* itself, which may be caused by tilting of the terminal 11*e*. Further, the cylindrical member 81 is rotated so that the end portion of the wire 22, which is held in abutment against the protrusion 81*a* protruding from the distal end of the cylindrical member 81, is caused to circle around the terminal 11*e*, and hence the wire 22 can be wound around the terminal 11*e* that is prohibited from tilting. Thus, according to this embodiment, even when the wire 22 has a relatively large diameter, the wire 22 can be reliably bound around the terminal 11*e* without breakage of the winding target member 11 or the terminal 11*e* itself.

Further, the protrusion 81*a* is formed at the position distant from the inner periphery of the cylindrical member 81, and thus a gap between the inner periphery of the cylindrical member 81 and the outer periphery of the terminal 11*e* can be further reduced. Accordingly, tilting of the terminal 11*e* can be prevented more effectively.

Further, in the related-art binding method in which the wire is wound around the winding drum of the winding target member after the wire at the start of winding is bound around the terminal, in a process in which the wire at the start of winding, which has already been bound around the terminal, is guided to the winding drum, the wire to be guided is placed on the wire already bound around the terminal, with the result that the outer diameter of the bound wire may be increased. However, according to this embodiment, as illustrated in FIG. 15, the cylindrical member 81 is moved upward while being rotated together with the protrusion 81*a*, and thus the wire 22*a* at the start of winding can be wound around the terminal 11*e* from the winding target member 11 side in a spiral manner. Thus, according to this embodiment, the wire 22 is not further placed over the wire 22 already bound around the terminal 11*e*, and thus it is possible to prevent increase in winding diameter of the wire 22 bound around the terminal 11*e*, which may be caused by overlapping of the wire 22 in a radial direction of the terminal 11*e*.

It should be noted that the above-mentioned embodiment is described with reference to the pin-like terminal 11*e* having a circular cross-section, but the terminal 11*e* is not limited to the pin-like terminal having a circular cross-section. The terminal 11*e* may have a bar-like or plate-like shape having a square cross-section.

Figure 16:
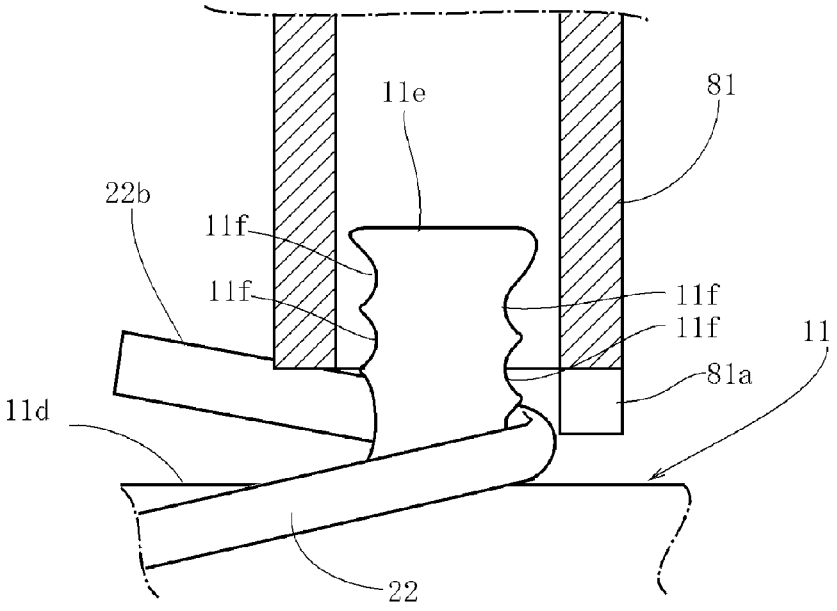
FIG. 16 is an enlarged cross-sectional view illustrating a state in which a plate-like terminal is inserted into the cylindrical member.
Figure 17:
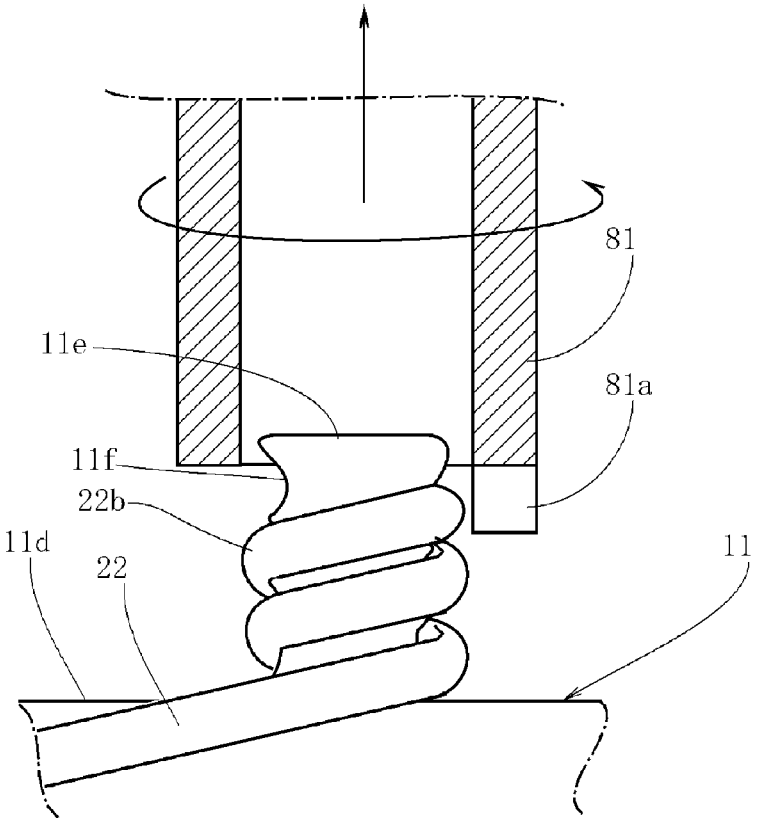
FIG. 17 is an enlarged cross-sectional view illustrating a state in which the cylindrical member, into which the plate-like terminal is inserted, is rotated to bind the wire at the start of winding around the terminal.

Further, in the above-mentioned embodiment, description is made of the cylindrical member 81 in which the protrusion 81*a* is formed at the position distant from the inner periphery of the cylindrical member 81. However, as illustrated in FIG. 16 and FIG. 17, the protrusion 81*a* may have such a shape that the outer periphery of the protrusion 81*a* is continuous with the inner periphery of the cylindrical member 81. The terminal 11*e* illustrated in FIG. 16 and FIG. 17 has a plate-like shape having a square cross-section. In both sides of the terminal 11*e*, there are formed a plurality of cutouts 11*f* into which the wire 22 to be bound around the terminal 11*e* is fitted. Even in this case, as the cylindrical member 81, a cylindrical member having an inner diameter enabling the terminal 11*e* to be inserted therein is used. The protrusion 81*a* is formed so as to sandwich, together with the terminal 11*e*, the wire 22 bound along the terminal 11*e* in a state in which the terminal 11*e* is inserted into the cylindrical member 81.

In a case where the cutouts 11*f*, into which the wire 22 to be bound is fitted, are formed in the both sides of the terminal 11*e*, as illustrated in FIG. 16, even when the protrusion 81*a* has such a shape that the outer periphery thereof is continuous with the inner periphery of the cylindrical member 81, the protrusion 81*a* can sandwich the wire 22 together with the terminal 11*e*. Accordingly, even in this case, as illustrated in FIG. 17, when the cylindrical member 81 is rotated about the terminal 11*e*, the protrusion 81*a* rotates about the terminal 11*e* and circles around the terminal 11*e*, to thereby cause the wire 22 sandwiched by the protrusion 81*a* and the terminal 11*e* to circle around the terminal 11*e*. In this manner, for example, the wire 22*b* at the end of winding can be bound around the terminal 11*e*.

Embodiments of this invention were described above, but the above embodiments are merely examples of applications of this invention, and the technical scope of this invention is not limited to the specific constitutions of the above embodiments.

This application claims priority based on Japanese Patent Application No. 2012-175542 filed with the Japan Patent Office on Aug. 8, 2012, the entire contents of which are incorporated into this specification.

The invention claimed is:

1. A winding device, comprising:

a chuck capable of gripping a winding target member comprising a winding drum around which a wire is to be wound, and a terminal around which the wire is to be bound;

a nozzle for feeding the wire toward the winding target member;

a binding member for locking thereon an end portion of the wire fed from the nozzle;

a winding mechanism for rotating the chuck together with the binding member so as to wind, around the winding target member, the wire fed from the nozzle;

a wire cutting mechanism for cutting the wire wound around the winding target member to form another end portion of the wire; and a wire binding mechanism for winding, around the terminal, the another end portion of the wire wound around the winding target member and cut by the wire cutting mechanism, wherein the wire binding mechanism includes a cylindrical member through which the terminal is insertable, and a rotating mechanism for rotating the cylindrical member about a center of the terminal that serves as a rotation center;

the cylindrical member includes a protrusion formed at a distal end of the cylindrical member so as to protrude in an axial direction of the cylindrical member; and the protrusion has a circular cross section having an outer diameter smaller than a thickness of a portion of the cylindrical member, the protrusion is formed at a position distant from an inner peripheral surface of the cylindrical member so as to sandwich the wire together with the terminal.

2. A winding device, comprising:

a chuck capable of gripping a winding target member comprising a winding drum around which a wire is to be wound, and a terminal around which the wire is to be bound, the terminal including a cutout into which the wire to be bound is fitted;

a nozzle for feeding the wire toward the winding target member;

a binding member for locking thereon an end portion of the wire fed from the nozzle;

a winding mechanism for rotating the chuck together with the binding member so as to wind, around the winding target member, the wire fed from the nozzle;

a wire cutting mechanism for cutting the wire wound around the winding target member to form another end portion of the wire; and a wire binding mechanism for winding, around the terminal, the another end portion of the wire wound around the winding target member and cut by the wire cutting mechanism, wherein the wire binding mechanism includes a cylindrical member through which the terminal is insertable, and a rotating mechanism for rotating the cylindrical member about the terminal;

the cylindrical member includes a protrusion formed at a distal end of the cylindrical member so as to protrude in an axial direction of the cylindrical member; and the protrusion has a circular cross section and is formed at a position distant from an inner peripheral surface of the cylindrical member so as to sandwich the wire together with the terminal.

3. A method of binding, around a terminal of a winding target member, a wire wound around the winding target member including the terminal, the method comprising:

aligning an end portion of the wound wire along the terminal;

moving, relative to each other, the terminal and a cylindrical member including a protrusion having a circular cross section and protruding from a distal end of the cylindrical member in an axial direction of the cylindrical member, so that the terminal is inserted into the cylindrical member, the protrusion having an outer diameter smaller than a thickness of a portion of the cylindrical member;

holding the end portion of the wound wire in abutment against the protrusion; and rotating the cylindrical member about a center of the terminal that serves as a rotation center so as to bind, around the terminal at a position distant from an inner peripheral surface of the cylindrical member, the end portion of the wound wire that is held in abutment against the protrusion.

4. The method of binding a wire around a terminal according to claim 3, wherein the terminal and the cylindrical member are moved in separate directions relative to each other with the rotating the cylindrical member.

5. The method of binding a wire around a terminal according to claim 3, wherein the cylindrical member is moved away from the terminal during the rotating the cylindrical member.

* * * * *